US007135813B2

(12) United States Patent
Takekawa et al.

(10) Patent No.: US 7,135,813 B2
(45) Date of Patent: Nov. 14, 2006

(54) COLOR BRAUN TUBE APPARATUS WITH NON-CIRCULAR ELECTRON BEAM PASSAGE APERTURE

(75) Inventors: Tsutomu Takekawa, Ibaraki (JP); Hirofumi Ueno, Ibaraki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 11/100,815

(22) Filed: Apr. 7, 2005

(65) Prior Publication Data

US 2005/0231094 A1 Oct. 20, 2005

(30) Foreign Application Priority Data

Apr. 20, 2004 (JP) ..... 2004-124628

(51) Int. Cl.
*H01J 29/50* (2006.01)

(52) U.S. Cl. ..... 313/414; 313/449; 313/409; 315/15; 315/382

(58) Field of Classification Search ..... 313/409, 313/414, 452–453, 449; 315/14–15, 382, 315/5.34

See application file for complete search history.

(56) References Cited

U.S. PATENT DOCUMENTS

| | | | | |
|---|---|---|---|---|
| 5,675,211 | A | 10/1997 | Ueda | |
| 6,339,293 | B1 * | 1/2002 | Kimiya et al. | 315/15 |
| 6,586,868 | B1 | 7/2003 | Takekawa et al. | |
| 2002/0185957 | A1 * | 12/2002 | Uchida et al. | 313/449 |

FOREIGN PATENT DOCUMENTS

| | | |
|---|---|---|
| CN | 1108429 | 9/1995 |
| CN | 1280378 | 1/2001 |
| EP | 0 646 944 | 9/1994 |
| JP | 8-22780 | 1/1996 |
| JP | 9-180648 | 7/1997 |

* cited by examiner

*Primary Examiner*—Joseph Williams
*Assistant Examiner*—Hana A. Sanei
(74) *Attorney, Agent, or Firm*—Hamre, Schumann, Mueller & Larson, P.C.

(57) ABSTRACT

A main lens is formed by a focus electrode, an intermediate electrode, and an anode electrode successively arranged in a traveling direction of an electron beam. The focus electrode and the anode electrode respectively have an electron beam passage aperture common to three electron beams, having a major axis in a horizontal direction in a portion opposed to the intermediate electrode, and three electron beam passage apertures through which the three electron beams pass are formed respectively in the focus electrode and the anode electrode. Aperture dimensions in a vertical direction of the electron beam passage apertures common to the three electron beams formed respectively in the focus electrode and the anode electrode are smaller than those in the vertical direction of the electron beam passage apertures formed in portions of the intermediate electrode respectively opposed to the focus electrode and the anode electrode. This can provide a color Braun tube apparatus that has less moire while having satisfactory focus performance over the entire surface of a phosphor screen, and in which there are no increase in the cost of a driving circuit and the decrease in withstand voltage characteristics.

6 Claims, 14 Drawing Sheets

COLOR BRAUN TUBE APPARATUS WITH NON-CIRCULAR ELECTRON BEAM PASSAGE APERTURE

BACKGROUND OF THE INVENTION

1. Field of the Invention

The present invention relates to a color Braun tube apparatus.

2. Description of the Related Art

Generally, as shown in FIG. 17, a color Braun tube apparatus has an envelope in which a panel 1 is integrally connected to a funnel 2. On an inner surface of the panel 1, a phosphor screen 4 composed of phosphor layers of three colors emitting red, green, and blue light is formed, and a shadow mask 3 with a number of electron beam passage apertures formed thereon is attached to an inner wall surface of the panel 1 so as to be opposed to the phosphor screen 4. An electron gun 6 is provided in a neck 5 of the funnel 2, and a deflection yoke 8 is mounted on an outer circumferential surface of the funnel 2. Three electron beams 7B, 7G, and 7R emitted from the electron gun 6 are deflected by a magnetic field generated by the deflection yoke 8 to scan the phosphor screen 4 in a horizontal direction and a vertical direction, whereby a color image is displayed on the phosphor screen 4.

Such a color Braun tube apparatus generally is an in-line type color Braun tube apparatus. The in-line type color Braun tube apparatus uses, as the electron gun 6, an in-line type electron gun emitting three electron beams in an in-line shape so that a center electron beam (hereinafter, referred to as a "center beam") at the center and a pair of side electron beams (hereinafter, referred to as "side beams") on both sides of the center beam are aligned on an identical horizontal plane, in which the magnetic field generated by the deflection yoke 8 is set to be a non-uniform magnetic field with a horizontal deflection magnetic field being a pin-cushion type and a vertical deflection magnetic field being a barrel type, whereby the three electron beams are self-converged.

As the in-line type electron gun, various kinds of systems are known, and one of them is a Bi-Potential Focus (BPF) type Dynamic Astigmatism and Focus correction (DAF) system.

Regarding a main lens configuration of the in-line type electron gun, various kinds of types also are known, and one of them is a superimposed electric field type.

FIGS. 18A and 18B show an example of the in-line type electron gun. FIG. 18A is a horizontal cross-sectional view thereof, and FIG. 18B is a vertical cross-sectional view thereof The electron gun is composed of three cathodes K arranged in a line in a horizontal direction, and a first grid G1 to a fourth grid G4 with an integrated configuration, arranged successively on a phosphor screen side with respect to the three cathodes K.

In the first grid G1 and the second grid G2, three electron beam passage apertures corresponding to the three cathodes K arranged in a line are formed respectively.

The (3-1)th grid G3-1 is composed of a tubular body in which three electron beam passage apertures are formed respectively on both end faces.

The (3-2)th grid (focus electrode) G3-2 is composed of a tubular body 10 in which three electron beam passage apertures are formed on an end face on an electron beam incident side (i.e., a surface opposed to the (3-1)th grid G3-1), and an oval electron beam passage aperture 9 common to the three electron beams, having a major axis in the arrangement direction of the three electron beams as shown in FIG. 19, is formed on an end face on an electron beam output side (i.e., a surface opposed to the fourth grid G4). In the (3-2)th grid G3-2, an electric field correcting plate 12 is placed in which three electron beam passage apertures 11B, 11G, 11R are formed.

The fourth grid (anode electrode) G4 is composed of a tubular body 14 in which an oval electron beam passage aperture 13 common to the three electron beams, having a major axis in the arrangement direction of the three electron beams as shown in FIG. 20, is formed on an end face on an electron beam incident side (i.e., a surface opposed to the (3-2)th grid G3-2). In the fourth grid G4, an electric field correcting plate 16 is placed in which three electron beam passage apertures 15B, 15G, 15R are formed.

The cathodes K are supplied with a voltage of about 150 V, the first grid G1 is grounded, and the second grid G2 is supplied with a voltage of about 600 V. The (3-1)th grid G3-1 is supplied with a focus voltage of about 8 kV, and the (3-2)th grid G3-2 is supplied with a dynamic focus voltage that increases in accordance with the deflection distance of the electron beams on a base of about 8 kV. The fourth grid G4 is supplied with a high voltage of about 30 kV.

Thus, the cathodes K, the first grid G1, and the second grid G2 constitute a tripolar part for generating electron beams and forming an object point with respect to a main lens (described later). The second grid G2 to the (3-1)th grid G3-1 form a prefocus lens for preliminary focusing the electron beams emitted from the tripolar part. When the electron beams are deflected, the (3-1)th grid G3-1 and the (3-2)th grid G3-2 form a quadrupole lens that has a focusing function in a horizontal direction and has a diverging function in a vertical direction. Furthermore, the (3-2)th grid G3-2 that is a focus electrode and the fourth grid G4 that is an anode electrode form a superimposed electric field type BPF main lens for finally accelerating and focusing the electron beams with respect to the phosphor screen.

In the above-mentioned electron gun, in the case where the electron beams travel to the center of the phosphor screen without being deflected, the quadrupole lens is not formed between the (3-1)th grid G3-1 and the (3-2)th grid G3-2. The electron beams from the tripolar part are preliminary focused by the prefocus lens, and then, focused at the center of the phosphor screen by the main lens.

In contrast, in the case where the electron beams are deflected to a circumferential portion of the phosphor screen, the voltage of the (3-2)th grid G3-2 increases in accordance with the deflection amount of the electron beams, and a quadrupole lens for focusing the electron beams in a horizontal direction and diverging them in a vertical direction is formed between the (3-1)th grid G3-1 and the (3-2)th grid G3-2. Simultaneously, the increase in the voltage of the (3-2)th grid G3-2 decreases the lens strength of the main lens formed by the (3-2)th grid G3-2 and the fourth grid G4. This corrects the deflection aberration generated by the enlargement of the distance between the main lens and the phosphor screen caused by the deflection of the electron beams, and the non-uniform electric field containing a pin-cushion type horizontal deflection magnetic field and a barrel type vertical deflection magnetic field generated by the deflection yoke.

In order to make the image quality of the color Braun tube satisfactory, it is necessary to make the focus characteristics on the phosphor screen satisfactory, i.e., to reduce the size of an electron beam spot over the entire surface of the phosphor screen.

As one means for reducing the size of an electron beam spot, there is a method for enlarging a main lens aperture of the electron gun. The above-mentioned superimposed electric field type main lens in the BPF-type electron gun generally is used as a configuration in which a lens with a larger aperture compared with that of a simple cylindrical lens is obtained.

However, since the electrode size is limited by the inner diameter of a neck, there is a limit to a lens aperture that can be formed, even with the superimposed electric field type main lens. JP8(1996)-22780A and JP9(1997)-180648A describe a method for obtaining a lens aperture larger than that of the superimposed electric field type main lens. FIGS. 21A and 21B show an exemplary case where this method is applied to the above-mentioned BPF-type DAF system electron gun. FIG. 21A is a horizontal cross-sectional view thereof, and FIG. 21B is a vertical cross-sectional view thereof.

The electron gun is different from the conventional electron gun forming a superimposed electric field type main lens shown in FIGS. 18A and 18B, in that an intermediate electrode GM is placed between the (3-2)th grid G3-2 and the fourth grid G4, and is supplied with a voltage higher than the third grid voltage (focus voltage) and lower than the fourth grid voltage (anode voltage), which is obtained by dividing an anode voltage with a resistor 17 housed in a tube. As shown in FIG. 22, the intermediate electrode GM is composed of a tubular body 20 in which an electron beam passage aperture 18 common to the three electron beams is formed on a surface opposed to the (3-2)th grid G3-2 that is an incident side surface of the electron beams, and an electron beam passage aperture 19 common to the three electron beams is formed on a surface opposed to the fourth grid G4 that is an output side surface of the electron beams, and an electric field correcting plate 22 having three electron beam passage apertures 21B, 21G, 21R placed inside the tubular body 20.

According to the above-mentioned electron gun, a main lens with an aperture larger than that of the superimposed electric field type main lens can be formed, so that an electron beam spot can be reduced in size, which can enhance the resolution of a color Braun tube.

However, when the electron beam spot is reduced in size, although the resolution is enhanced, moire is likely to be generated on a screen due to the interference between the scanning lines and the shadow mask, which rather impairs image quality. This is caused by the extremely small vertical dimension of the electron beam spot.

Furthermore, as the main lens aperture is larger, the change in a focal length with respect to a focus voltage decreases, which makes it necessary to increase further the amplitude of a dynamic focus voltage in the DAF system electron gun. This increases the cost of a driving circuit and decreases withstand voltage reliability.

That is, it is desirable that while the aperture of a main lens in a horizontal direction is as large as possible, the aperture thereof in a vertical direction is set appropriately. More specifically, the aperture in a vertical direction preferably is about 5 to 9 mm. However, a desirable main lens cannot be formed with the prior art.

SUMMARY OF THE INVENTION

The present invention solves the above-mentioned conventional problems, and its object is to provide a color Braun tube apparatus in which satisfactory focus performance is obtained over the entire surface of a phosphor screen with less moire and the increase in amplitude of a dynamic focus voltage is suppressed, and consequently, there are no increase in the cost of a driving circuit and no decrease in withstand voltage characteristics.

A color Braun tube apparatus according to the present invention includes an electron gun having an electron beam generating part for generating three electron beams, including a center electron beam and a pair of side electron beams on both sides of the center electron beam, on an identical horizontal plane and a plurality of electrodes that form a main lens and have an electron beam passage aperture, and a deflection yoke for allowing the three electron beams emitted from the electron gun to scan in a horizontal direction and a vertical direction. The main lens accelerates and focuses the three electron beams generated from the electron beam generating part with respect to a screen.

The main lens is formed by a focus electrode to be supplied with a focus voltage, at least one intermediate electrode to be supplied with an intermediate voltage higher than the focus voltage, and an anode electrode to be supplied with an anode voltage higher than the intermediate voltage, arranged successively in a traveling direction of the three electron beams.

The focus electrode and the anode electrode respectively are composed of a tubular body in which a noncircular electron beam passage aperture common to the three electron beams, having a major axis in the horizontal direction and a minor axis in the vertical direction, is formed in a portion opposed to the intermediate electrode, and three electron beam passage apertures through which the three electron beams pass are formed in the respective tubular bodies constituting the focus electrode and the anode electrode.

An aperture dimension in the vertical direction of the noncircular electron beam passage aperture common to the three electron beams formed in the focus electrode is smaller than an aperture dimension in the vertical direction of the electron beam passage aperture formed in a portion of the intermediate electrode opposed to the focus electrode, and an aperture dimension in the vertical direction of the noncircular electron beam passage aperture common to the three electron beams formed in the anode electrode is smaller than an aperture dimension in the vertical direction of the electron beam passage aperture formed in a portion of the intermediate electrode opposed to the anode electrode.

These and other advantages of the present invention will become apparent to those skilled in the art upon reading and understanding the following detailed description with reference to the accompanying figures.

DESCRIPTION OF THE PREFERRED EMBODIMENTS

Figure 1A:
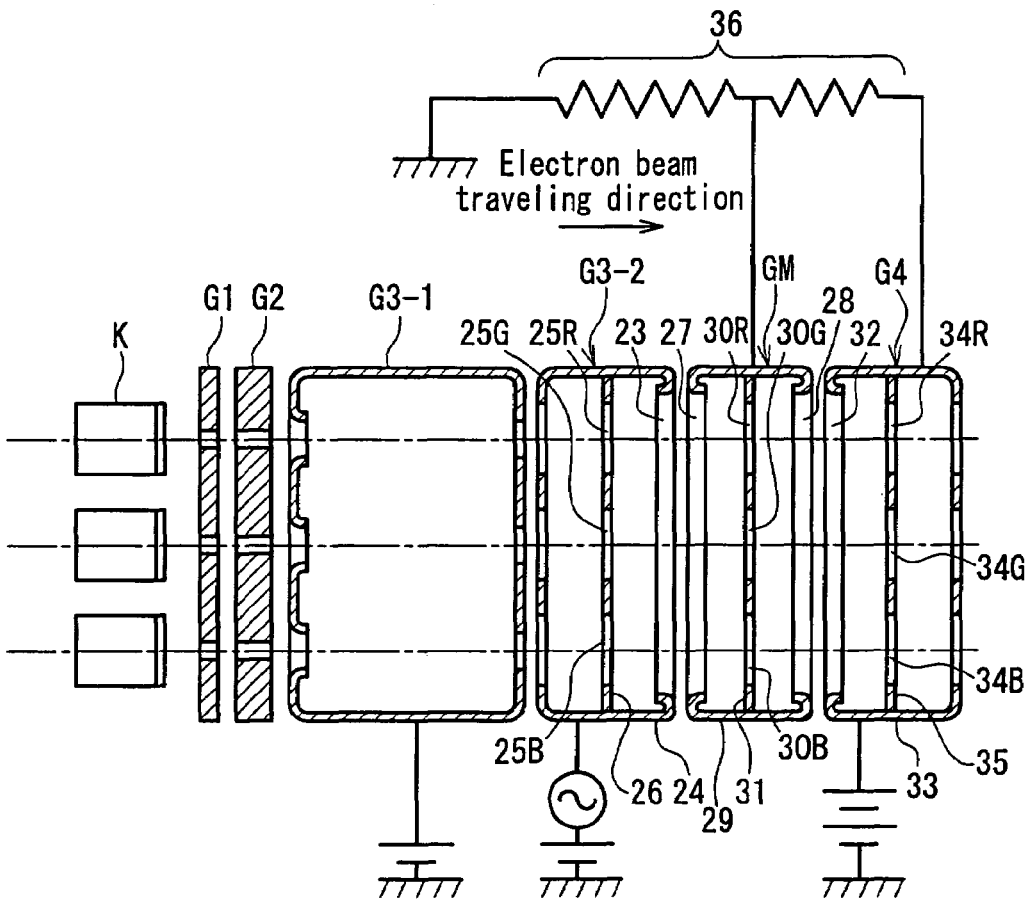
FIG. 1A is a horizontal cross-sectional view of an in-line type electron gun according to Embodiment 1 of the present invention.

According to the present invention, a color Braun tube apparatus can be provided, which has satisfactory image quality with less moire while having satisfactory focus performance over the entire surface of a phosphor screen, and in which there are no increase in the cost of a driving circuit and no decrease in withstand voltage reliability.

The electron gun of the color Braun tube apparatus of the present invention includes the intermediate electrode between the focus electrode and the anode electrode, which form a conventional superimposed electric field type main lens, so that the distance between the focus electrode and the anode electrode can be made longer. This enlarges a lens region in the electron beam traveling direction, and reduces the lens magnification and spherical aberration of the main lens in the horizontal and vertical directions.

In addition, the aperture dimensions in the vertical direction of the noncircular electron beam passage apertures common to the three electron beams formed in the focus electrode and the anode electrode are smaller than those in the vertical direction of the electron beam passage apertures formed in the portions of the intermediate electrode respectively opposed to the focus electrode and the anode electrode. Therefore, the main lens has a relatively weak focusing function and a relatively weak diverging function in the horizontal direction, and has a relatively strong focusing function and a relatively strong diverging function in the vertical direction. Consequently, the lens magnification and spherical aberration in the horizontal direction are reduced further. On the other hand, the lens magnification and spherical aberration in the vertical direction increase, which compensates for above-mentioned reduction in the lens magnification and spherical aberration.

As a result, a main lens with a large aperture having a very low lens magnification and spherical aberration in the horizontal direction can be formed, and a main lens with an appropriate aperture having an appropriate lens magnification and spherical aberration in the vertical direction can be formed. More specifically, a main lens with a horizontal aperture larger than that of the conventional example and an appropriate vertical aperture can be formed.

This can further reduce the horizontal dimension of an electron beam spot, and maintain the vertical dimension thereof in an appropriate size. Consequently, a screen with less moire while having satisfactory focus performance over the entire surface of a phosphor screen can be realized.

Furthermore, even if the present invention is applied to a DAF system electron gun, it is not necessary to increase the amplitude of a dynamic focus voltage, and the increase in the cost of a circuit and the decrease in withstand voltage characteristics can be suppressed.

In the above-mentioned color Braun tube apparatus of the present invention, it is preferable that the intermediate electrode is composed of a tubular body in which a noncircular electron beam passage aperture common to the three electron beams, having a major axis in the horizontal direction and a minor axis in the vertical direction, is formed in the portion opposed to the focus electrode. According to this configuration, a lens electric field formed by the intermediate electrode becomes the one common to the three electron beams in the horizontal direction, whereby the lens magnification and the spherical aberration in the horizontal direction can be reduced, and the lens aperture in the horizontal direction can be enlarged.

Alternatively, it is preferable that the intermediate electrode is composed of a tubular body in which a noncircular electron beam passage aperture common to the three electron beams, having a major axis in the horizontal direction and a minor axis in the vertical direction, is formed in the portion opposed to the anode electrode. According to this configuration, a lens electric field formed by the intermediate electrode becomes the one common to the three electron beams in the horizontal direction, whereby the lens magnification and the spherical aberration in the horizontal direction can be reduced, and the lens aperture in the horizontal direction can be enlarged.

Alternatively, it is preferable that the intermediate electrode is composed of a tubular body in which a noncircular electron beam passage aperture common to the three electron beams, having a major axis in the horizontal direction and a minor axis in the vertical direction, is formed respectively in the portion opposed to the focus electrode and the portion opposed to the anode electrode. According to this configuration, a lens electric field formed by the intermediate electrode becomes the one common to the three electron beams in the horizontal direction, whereby the lens magnification and spherical aberration in the horizontal direction can be reduced, and the lens aperture in the horizontal direction can be enlarged.

Furthermore, it is preferable that, assuming that a potential difference between the focus electrode and the intermediate electrode opposed to the focus electrode is E1, and a potential difference between the anode electrode and the intermediate electrode opposed to the anode electrode is E2, a relationship E1<E2 is satisfied. According to this configuration, the focusing region in the main lens region can be prolonged in the electron beam traveling direction. Thus, the lens magnification and spherical aberration can be reduced further.

Hereinafter, the present invention will be described in detail by way of specific embodiments with reference to the drawings.

Figure 17:
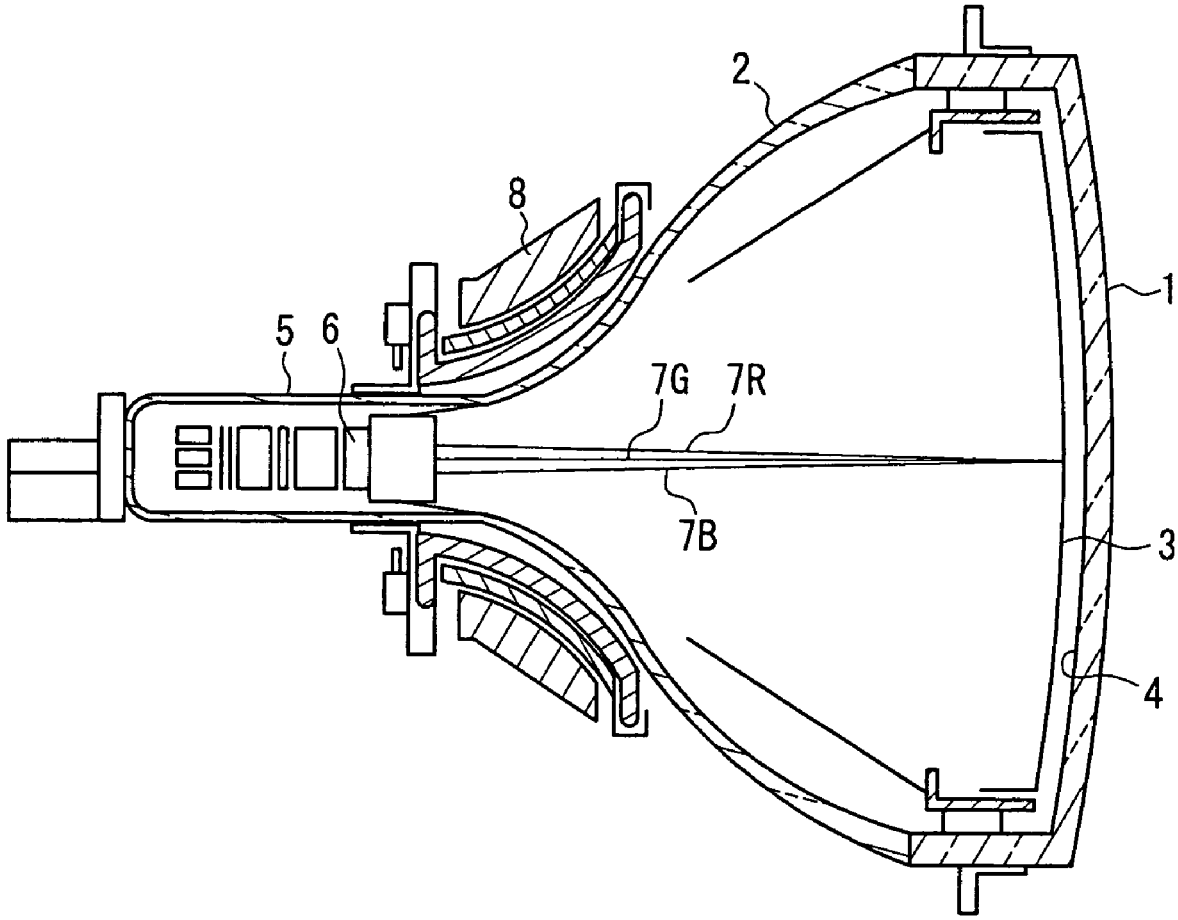
FIG. 17 is a cross-sectional view showing an example of a configuration of a color Braun tube apparatus.
Figure 18A:
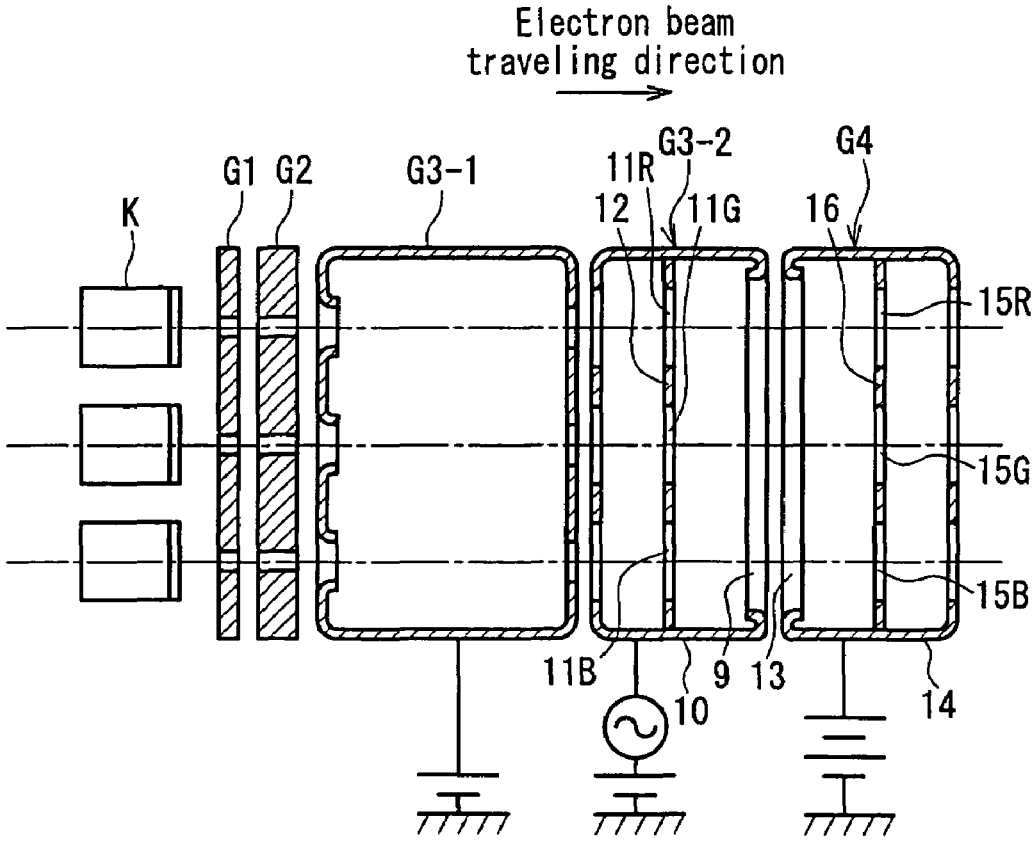
FIG. 18A PRIOR ART
FIG. 18A is a horizontal cross-sectional view of an example of a conventional in-line type electron gun.
Figure 18B:
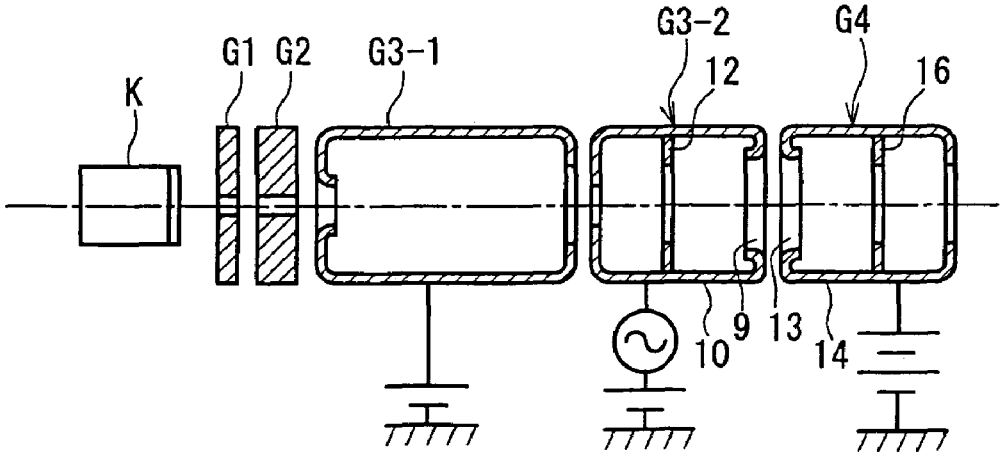
FIG. 18B PRIOR ART
FIG. 18B is a vertical cross-sectional view of an example of the conventional in-line type electron gun.
Figure 19:
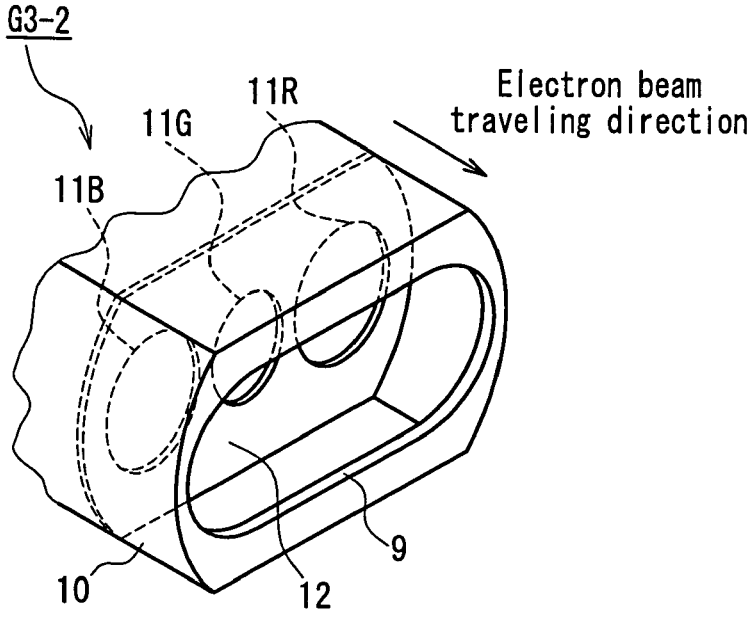
FIG. 19 PRIOR ART
FIG. 19 is a perspective view showing a portion of a focus electrode used in the in-line type electron gun shown in FIGS. 18A and 18B, opposed to an anode electrode.
Figure 20:
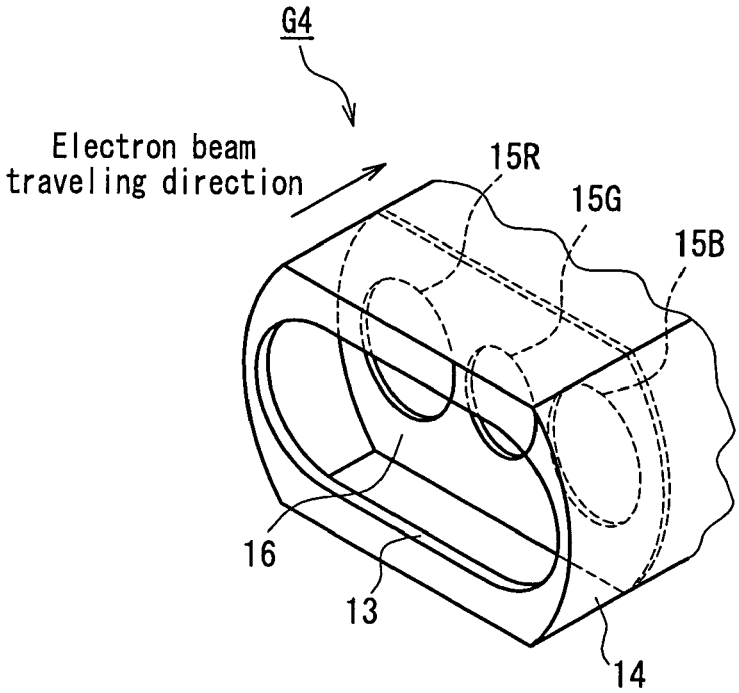
FIG. 20 PRIOR ART
FIG. 20 is a perspective view showing a portion of the anode electrode used in the in-line type electron gun shown in FIGS. 18A and 18B, opposed to the focus electrode.
Figure 21A:
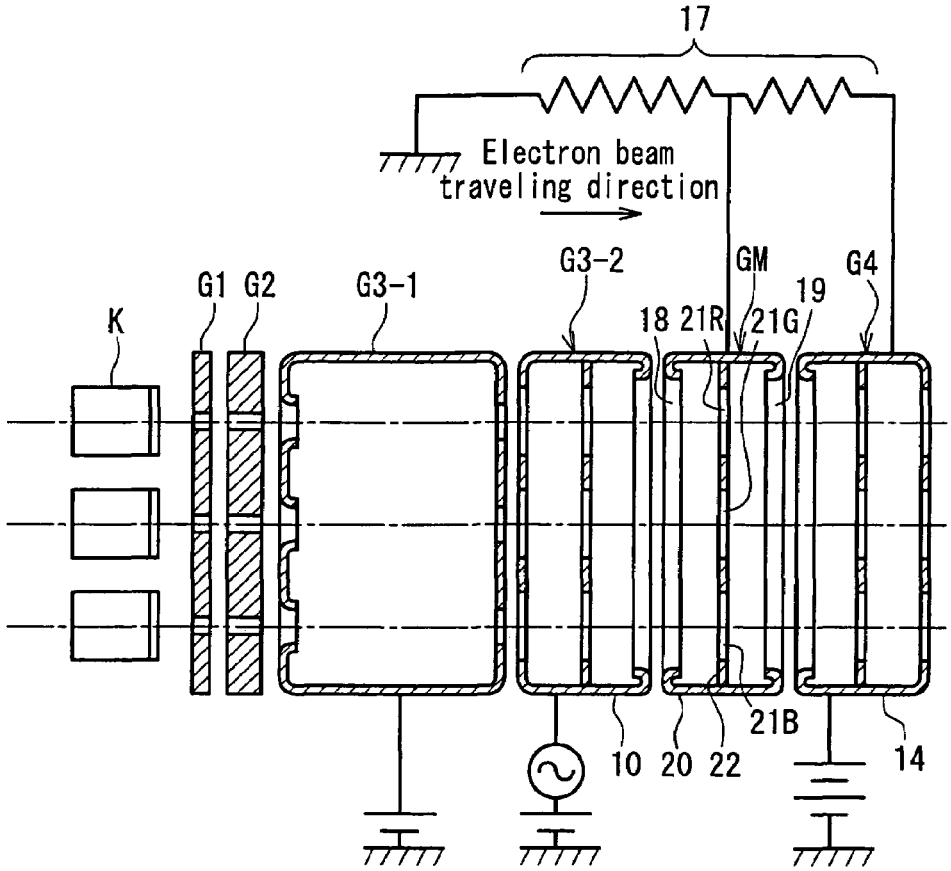
FIG. 21A PRIOR ART
FIG. 21A is a horizontal cross-sectional view of an example of a conventional in-line type electron gun in which a main lens aperture is enlarged.
Figure 21B:
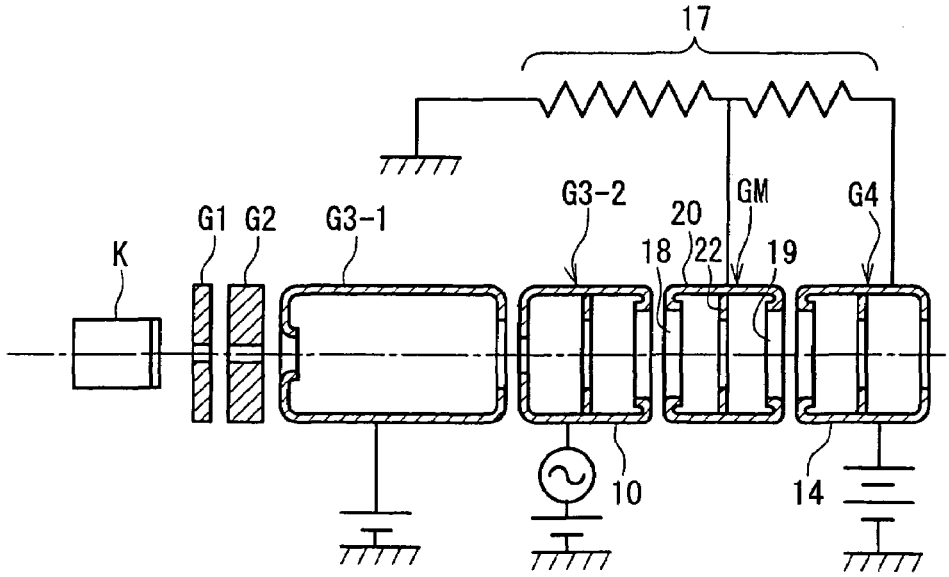
FIG. 21B PRIOR ART
FIG. 21B is a vertical cross-sectional view of an example of the conventional in-line type electron gun in which a main lens aperture is enlarged.
Figure 22:
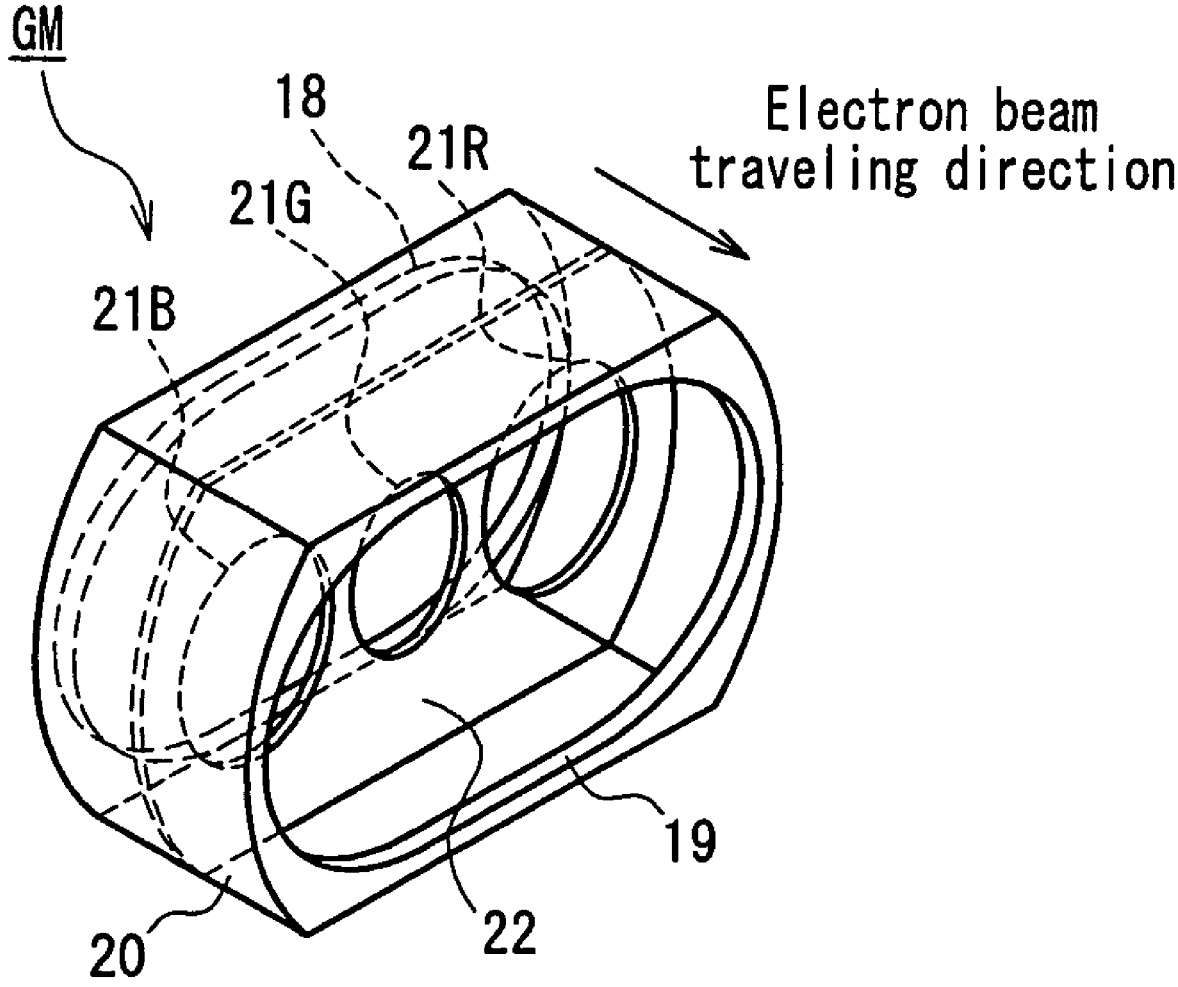
FIG. 22 PRIOR ART
FIG. 22 is a perspective view showing an intermediate electrode used in the in-line type electron gun shown in FIGS. 21A and 21B.

A color Braun tube apparatus of the present invention is not particularly limited except for the configuration of an electron gun. For example, the color Braun tube apparatus of the present invention may be the same as the conventional color Braun tube apparatus shown in FIG. 17. Thus, the redundant description is omitted, and the electron gun to be mounted on the color Braun tube apparatus of the present invention will be described below.

Embodiment 1

Figure 1B:
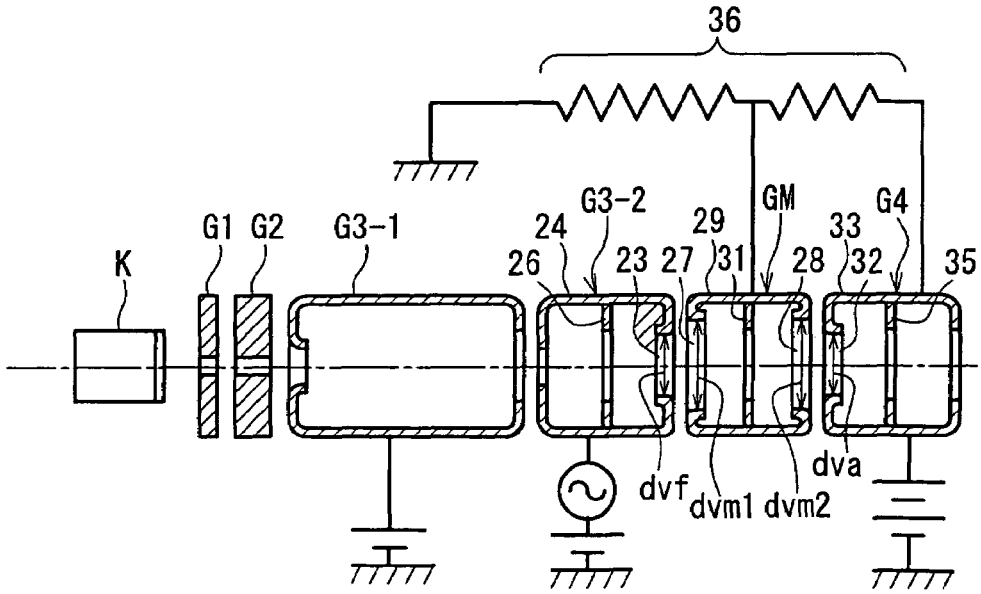
FIG. 1B is a vertical cross-sectional view of the in-line type electron gun according to Embodiment 1 of the present invention.

FIG. 1A is a horizontal cross-sectional view of an in-line type electron gun according to Embodiment 1 of the present invention. FIG. 1B is a vertical cross-sectional view thereof. The electron gun of Embodiment 1 is an in-line type electron gun that emits three electron beams including a center beam and a pair of side beams on both sides of the center beam so that they are aligned on an identical horizontal plane. The electron gun is composed of three cathodes K arranged in a line in a horizontal direction, and a first grid G1 to a fourth grid G4 with an integrated configuration, arranged successively on a phosphor screen side with respect to the three cathodes K.

In the first grid G1 and the second grid G2, three electron beam passage apertures corresponding to the three cathodes K arranged in a line are formed respectively.

The (3-1)th grid G3-1 is composed of a tubular body in which three electron beam passage apertures, respectively corresponding to the three electron beams, are formed respectively on both end faces.

Figure 2:
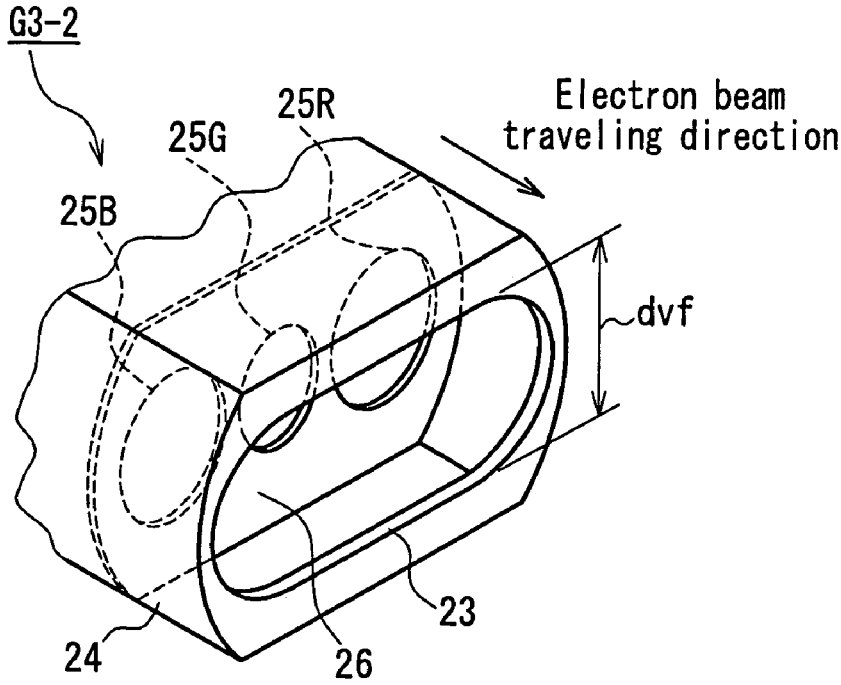
FIG. 2 is a perspective view showing a portion of a focus electrode used in the electron guns of Embodiments 1 and 2 of the present invention, opposed to an intermediate electrode.

The (3-2)th grid (focus electrode) G3-2 is composed of a tubular body 24 in which three electron beam passage apertures are formed on an end face on an electron beam incident side (i.e., a surface opposed to the (3-1)th grid G3-1), and an oval electron beam passage aperture 23 common to the three electron beams, having a major axis in the arrangement direction (horizontal direction) of the three electron beams and a minor axis in a direction orthogonal to the major axis (vertical direction) as shown in FIG. 2, is formed on an end face on an electron beam output side (i.e., a surface opposed to an intermediate electrode GM). In the (3-2)th grid G3-2, an electric field correcting plate 26 is placed in which three electron beam passage apertures 25B, 25G, 25R respectively corresponding to the three electron beams are formed.

Figure 3:
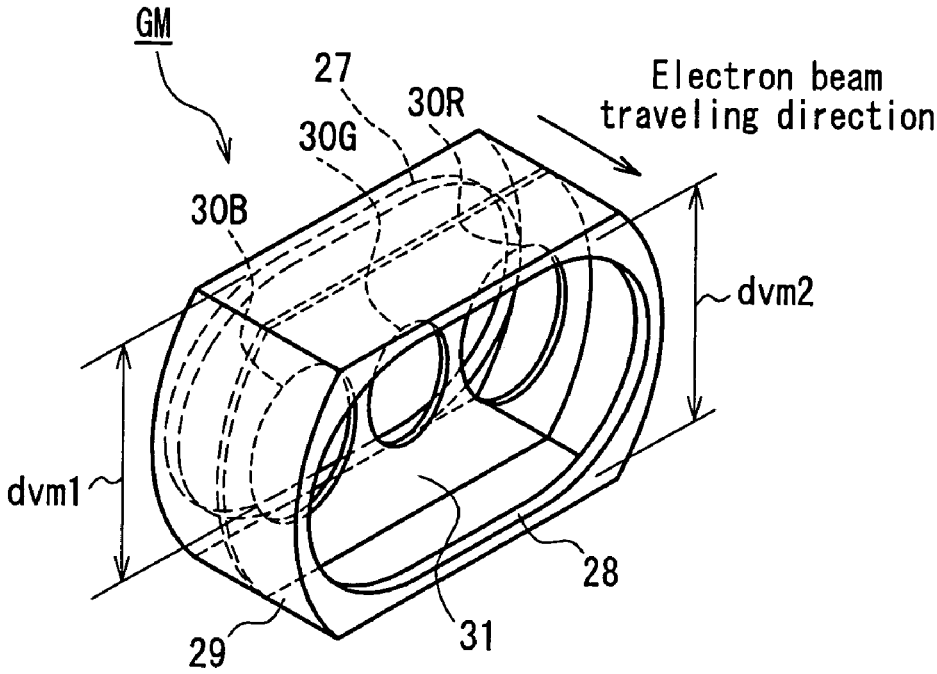
FIG. 3 is a perspective view showing the intermediate electrode used in the electron gun of Embodiment 1 of the present invention.

As shown in FIG. 3, the intermediate electrode GM is composed of a tubular body 29 in which oval electron beam passage apertures 27, 28 common to the three electron beams, having a major axis in the arrangement direction (horizontal direction) of the three electron beams and a minor axis in a direction orthogonal to the major axis (vertical direction), are formed respectively on an end face on an electron beam incident side (i.e., a surface opposed to the (3-2)th grid G3-2), and an end face on an electron beam output side (i.e., a surface opposed to the fourth grid G4). In the intermediate electrode GM, an electric field correcting plate 31 is placed in which three electron beam passage apertures 30B, 30G, 30R respectively corresponding to the three electron beams are formed.

The fourth grid (anode electrode) G4 is composed of a tubular body 33 in which an oval electron beam passage aperture 32 common to the three electron beams, having a major axis in the arrangement direction (horizontal direction) of the three electron beams and a minor axis in a direction orthogonal to the major axis (vertical direction), is formed on an end face on an electron beam incident side (i.e., a surface opposed to the intermediate electrode GM), and three electron beam passage apertures are formed on an end face on an electron beam output side. In the fourth grid G4, an electric field correcting plate 35 is placed in which three electron beam passage apertures 34B, 34G, 34R respectively corresponding to the three electron beams are formed.

A vertical dimension $d_{vf}$ of the electron beam passage aperture 23 common to the three electron beams of the (3-2)th grid G3-2 is smaller than a vertical dimension $d_{vm1}$ of the electron beam passage aperture 27 common to the three electron beams formed on the surface of the intermediate electrode GM on the side opposed to the (3-2)th grid G3-2. Furthermore, a vertical dimension $d_{va}$ of the electron beam passage aperture 32 common to the three electron beams of the fourth grid G4 is smaller than a vertical dimension $d_{vm2}$ of the electron beam passage aperture 28 common to the three electron beams formed on the surface of the intermediate electrode GM on the side opposed to the fourth grid G4.

In the above-mentioned electron gun, the cathodes K are supplied with a voltage of about 150 V, the first grid G1 is grounded, and the second grid G2 is supplied with a voltage of about 600 V. The (3-1)th grid G3-1 is supplied with a focus voltage of about 8 kV, and the (3-2)th grid G3-2 is supplied with a dynamic focus voltage that increases in accordance with the deflection distance of the electron beams on a base of about 8 kV. The intermediate electrode GM is supplied with a voltage (intermediate voltage) higher than the (3-2)th grid voltage (dynamic focus voltage), which is obtained by dividing an anode voltage with a resistor 36 housed in a tube. More specifically, the intermediate voltage is about 10 kV to about 20 kV. In the present embodiment, the intermediate voltage is set to be about 15 kV. The fourth grid G4 is supplied with a voltage (anode voltage) of about 30 kV, which is higher than the intermediate voltage. Thus, in the present embodiment, a potential difference E1 between the (3-2)th grid G3-2 and the intermediate electrode GM is about 7 kV or less, and a potential difference E2 between the intermediate electrode GM and the fourth grid G4 is about 15 kV. Thus, a relationship E1<E2 is satisfied.

Owing to the above configuration, the main lens formed by the (3-2)th grid G3-2 to the fourth grid G4 has an appropriate aperture in the vertical direction while having a large aperture in the horizontal direction. For example, in the case of an electron gun to be mounted on a color Braun tube having a neck diameter of ϕ29 mm, if the vertical dimension $d_{vf}$ of the electron beam passage aperture 23 common to the three electron beams of the (3-2)th grid G3-2 is set to be about 4 mm, the vertical dimensions $d_{vm1}$ and $d_{vm2}$ of the electron beam passage apertures 27, 28 common to the three electron beams of the intermediate electrode GM are set to be about 9 mm, and the vertical dimension $d_{va}$ of the electron beam passage aperture 32 common to the three electron beams of the fourth grid G4 is set to be about 4 mm, the horizontal aperture of the main lens becomes about 17 mm and the vertical aperture thereof becomes about 5 mm.

Furthermore, if the vertical dimension $d_{vf}$ of the electron beam passage aperture 23 common to the three electron beams of the (3-2)th grid G3-2 is set to be about 7 mm, the vertical dimensions $d_{vm1}$ and $d_{vm2}$ of the electron beam passage apertures 27, 28 common to the three electron beams of the intermediate electrode GM are set to be about 9 mm, and the vertical dimension $d_{va}$ of the electron beam passage aperture 32 common to the three electron beams of the fourth grid G4 is set to be about 7 mm, the horizontal aperture of the main lens becomes about 15 mm, and the vertical aperture thereof becomes about 7 mm.

Alternatively, if the vertical dimension $d_{vf}$ of the electron beam passage aperture 23 common to the three electron beams of the (3-2)th grid G3-2 is set to be about 8 mm, the vertical dimensions $d_{vm1}$ and $d_{vm2}$ of the electron beam passage apertures 27, 28 common to the three electron beams of the intermediate electrode GM are set to be about 9 mm, and the vertical dimension $d_{va}$ of the electron beam passage aperture 32 common to the three electron beams of the fourth grid G4 is set to be about 8 mm, the horizontal aperture of the main lens becomes about 13 mm, and the vertical aperture thereof becomes about 9 mm.

The electron beams, which have been emitted from the electron gun of the present embodiment and reached the center of the phosphor screen, can form a spot with a small dimension in the horizontal direction and with an appropriate dimension to such a degree as not to cause moire in the vertical direction.

Furthermore, the main lens does not have an excessively large aperture in the vertical direction, so that the necessity of increasing the amplitude of a dynamic focus voltage can be suppressed. Thus, the increase in the cost of a driving circuit and the decrease in withstand voltage reliability can be prevented.

Figure 5:
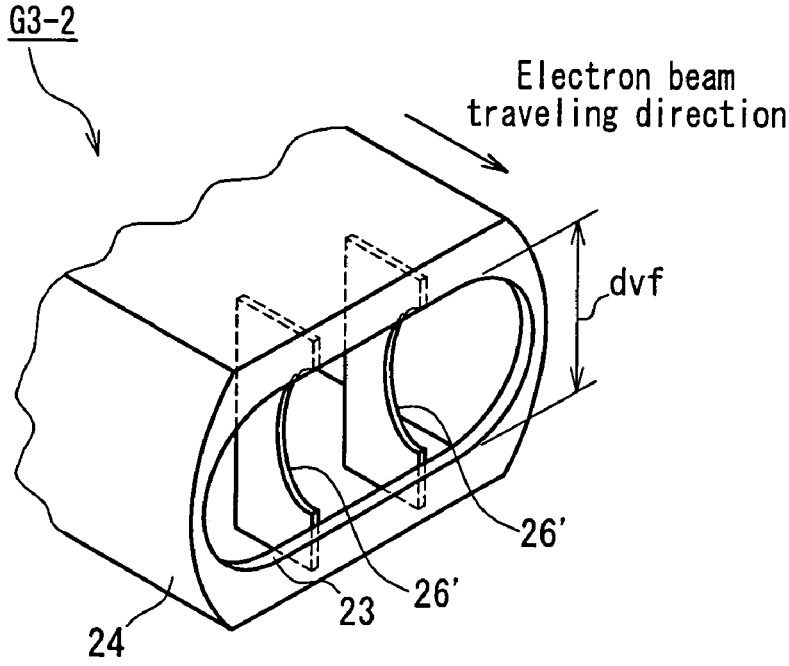
FIG. 5 is a perspective view showing another example of the portion of the focus electrode used in the electron guns of Embodiments 1 and 2 of the present invention, opposed to the intermediate electrode.
Figure 6:
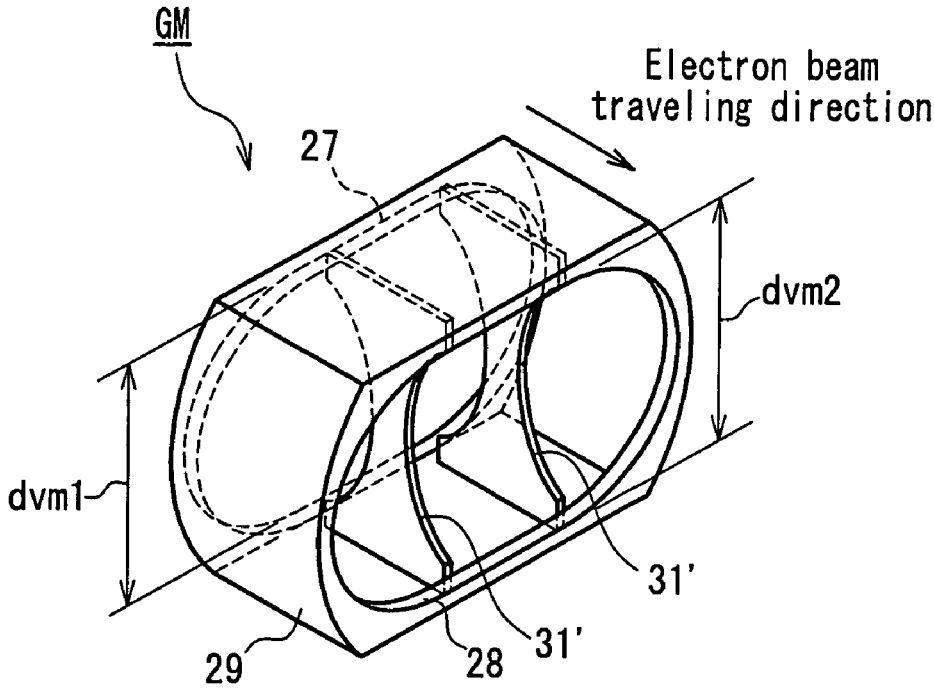
FIG. 6 is a perspective view showing another example of the intermediate electrode used in the electron gun of Embodiment 1 of the present invention.
Figure 7:
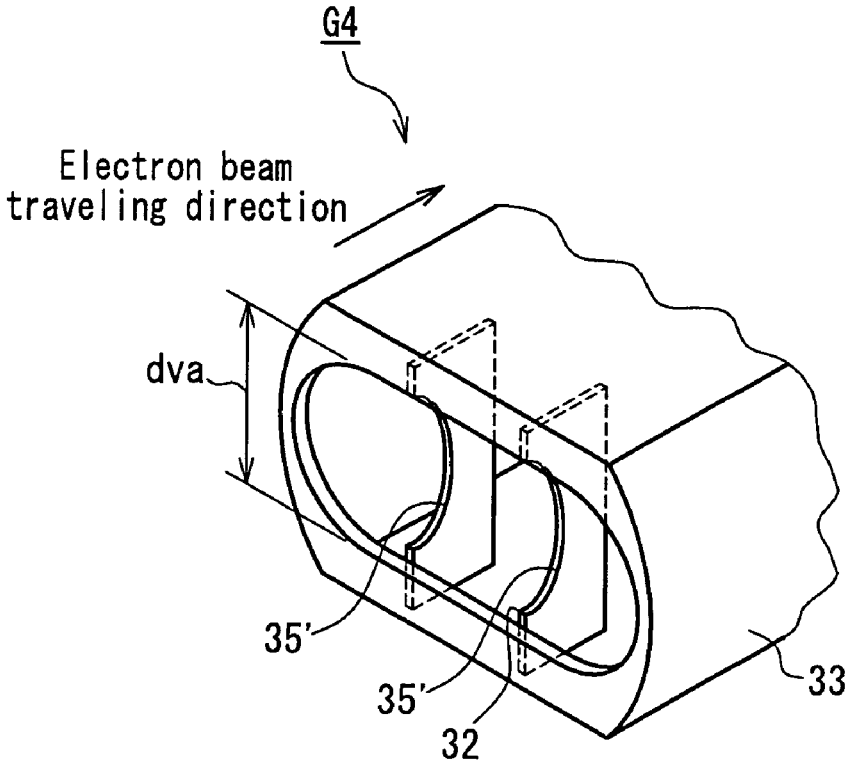
FIG. 7 is a perspective view showing another example of the portion of the anode electrode used in the electron guns of Embodiments 1 and 2 of the present invention, opposed to the intermediate electrode.

In the above example, in order to form three electron beam passage apertures through which the three electron beams pass in the respective tubular bodies 24, 29, 33, the (3-2)th grid G3-2, the intermediate electrode GM, and the fourth grid G4 respectively are provided with one electric field correcting plate 26, 31, 35 placed at a right angle with respect to the traveling direction of the electron beams. However, the present invention is not limited thereto. For example, as shown in FIGS. 5, 6, and 7, in the (3-2)th grid G3-2, the intermediate electrode GM, and the fourth grid G4, three electron beam passage apertures may be formed in the tubular bodies 24, 29, 33 respectively with two electric field correcting plates 26', 31', 35' placed in parallel in the vertical direction and the traveling direction of the electron beams. Furthermore, a method for forming the three electron beam passage apertures may be varied depending upon the electrode. For example, regarding the (3-2)th grid G3-2 and the fourth grid G4, three electron beam passage apertures may be formed with one electric field correcting plate 26, 35 shown in FIGS. 2 and 4, and regarding the intermediate electrode GM, three electron beam passage apertures may be formed with two electric field correcting plates 31' shown in FIG. 6.

Figure 8:
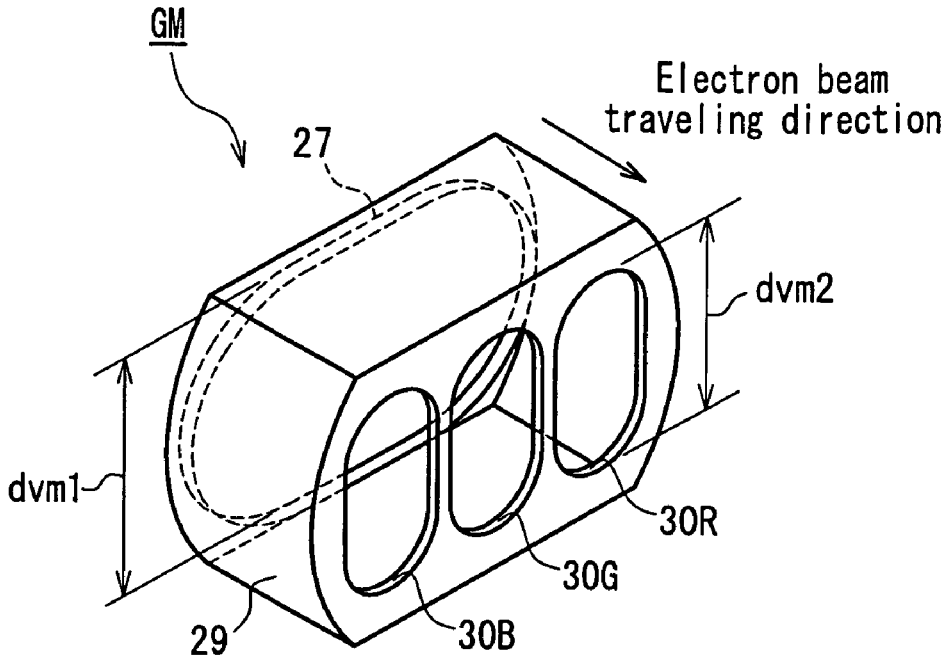
FIG. 8 is a perspective view showing still another example of the intermediate electrode used in the electron gun of Embodiment 1 of the present invention.
Figure 9:
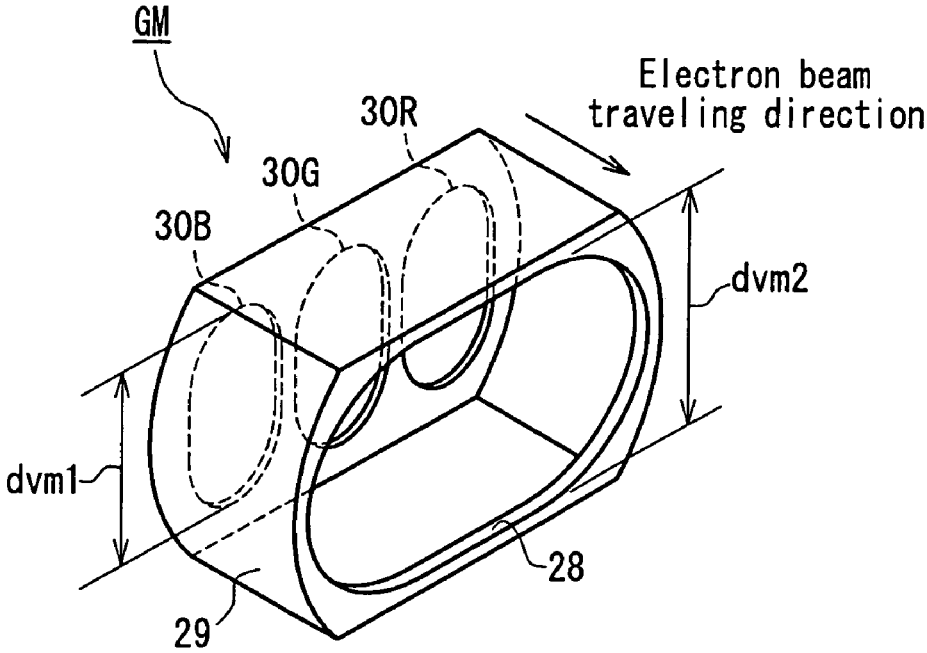
FIG. 9 is a perspective view showing still another example of the intermediate electrode used in the electron gun of Embodiment 1 of the present invention.

Furthermore, regarding the intermediate electrode GM, the electric field correcting plates 26, 26' may be omitted. In this case, for example, as shown in FIG. 8, an oval electron beam passage aperture 27 (vertical dimension $d_{vm1}$) common to the three electron beams may be formed on the surface opposed to the (3-2)th grid G3-2, and three electron beam passage apertures 30B, 30G, 30R (vertical dimension $d_{vm2}$) respectively corresponding to the three electron beams may be formed on the surface opposed to the fourth grid G4. Alternatively, as shown in FIG. 9, the three electron beam passage apertures 30B, 30G, 30R (vertical dimension $d_{vm1}$) respectively corresponding to the three electron beams may be formed on the surface opposed to the (3-2)th grid G3-2, and an oval electron beam passage aperture 28 (vertical dimension $d_{vm2}$) common to the three electron beams may be formed on the surface opposed to the fourth grid G4. Irrespective of the configuration of the intermediate electrode GM, the vertical dimension $d_{vf}$ of the oval electron beam passage aperture 23 common to the three electron beams formed on the end face on the electron beam output side of the (3-2)th grid (focus electrode) G3-2 only needs to be smaller than the vertical dimension $d_{vm1}$ of the electron beam passage aperture formed on the end face on the electron beam incident side of the intermediate electrode GM opposed to the (3-2)th grid, and the vertical dimension $d_{va}$ of the oval electron beam passage aperture 32 common to the three electron beams formed on the end face on the electron beam incident side of the fourth grid (anode electrode) G4 only needs to be smaller than the vertical dimension $d_{vm2}$ of the electron beam passage aperture formed on the end face on the electron beam output side of the intermediate electrode GM opposed to the fourth grid G4.

In the above description, the electron gun to be mounted on a color Braun tube having a neck diameter of ϕ29 mm has been shown. However, this is merely an example, and the present invention also is applicable to a color Braun tube having another neck diameter. In this case, although the sizes of the electrodes are varied from those described above, the ratio between the horizontal aperture of the main lens and the vertical aperture thereof becomes substantially the same as that described above, as long as the ratio of the vertical dimensions of the electron beam passage apertures common to the three electron beams of the respective electrodes is the same.

Embodiment 2

Figure 10A:
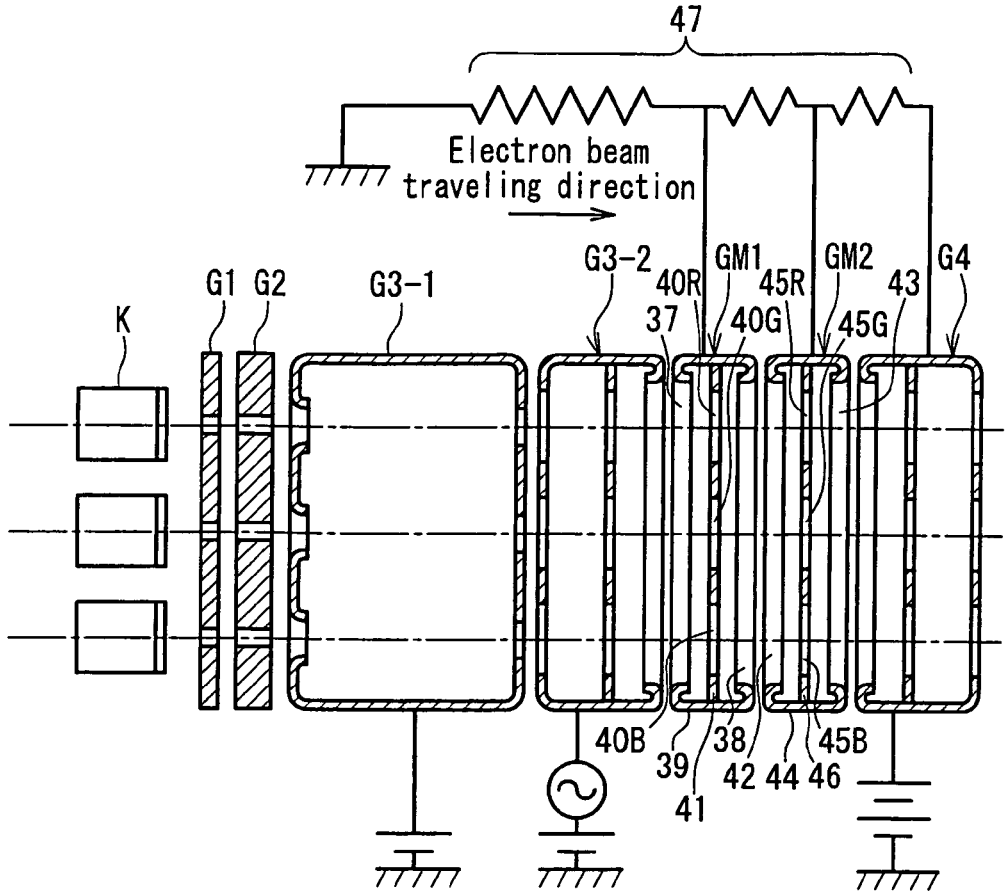
FIG. 10A is a horizontal cross-sectional view of an in-line type electron gun according to Embodiment 2 of the present invention.
Figure 10B:
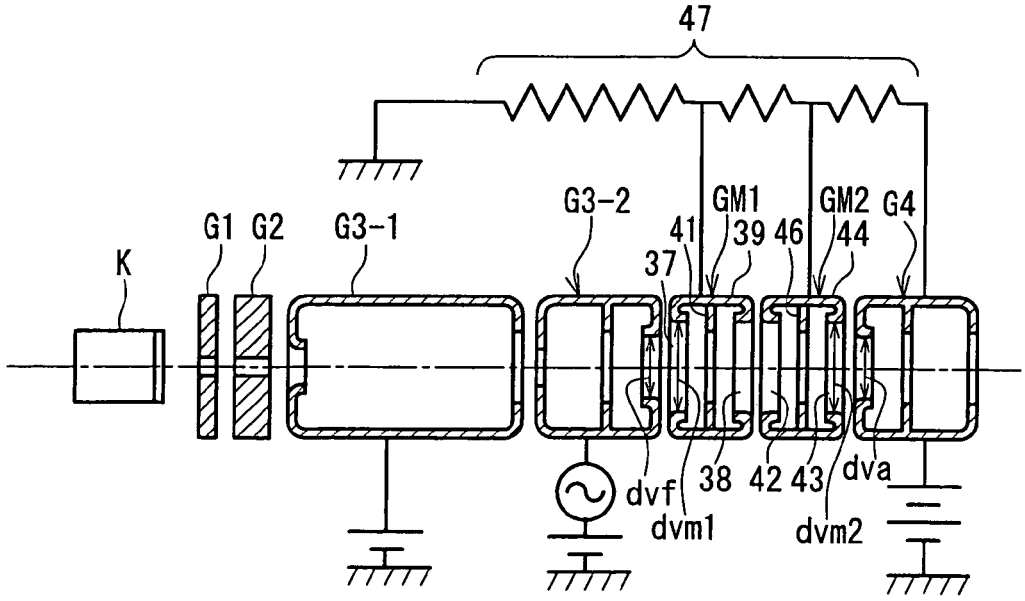
FIG. 10B is a vertical cross-sectional view of the in-line type electron gun according to Embodiment 2 of the present invention.

FIG. 10A is a horizontal cross-sectional view of an in-line type electron gun according to Embodiment 2 of the present invention. FIG. 10B is a vertical cross-sectional view thereof. The electron gun of Embodiment 2 is an in-line type electron gun that emits three electron beams including a center beam and a pair of side beams on both sides of the center beam so that they are aligned on an identical horizontal plane. The electron gun is composed of three cathodes K arranged in a line in a horizontal direction, and a first grid G1 to a fourth grid G4 with an integrated configuration, arranged successively on a phosphor screen side with respect to the three cathodes K. The electron gun of the present embodiment is different from that of Embodiment 1 having only one intermediate electrode GM, in that two intermediate electrodes GM1, GM2 are provided between the (3-2)th grid (focus electrode) G3-2 and the fourth grid (anode electrode) G4.

In the first grid G1 and the second grid G2, three electron beam passage apertures corresponding to the three cathodes K arranged in a line are formed respectively.

The (3-1)th grid G3-1 is composed of a tubular body in which three electron beam passage apertures, respectively corresponding to the three electron beams, are formed respectively on both end faces.

The (3-2)th grid (focus electrode) G3-2 is composed of a tubular body 24 in which three electron beam passage apertures are formed on an end face on an electron beam incident side (i.e., a surface opposed to the (3-1)th grid G3-1), and in the same way as in Embodiment 1 as shown in FIG. 2, an oval electron beam passage aperture 23 common to the three electron beams, having a major axis in the arrangement direction (horizontal direction) of the three electron beams and a minor axis in a direction orthogonal to the major axis (vertical direction), is formed on an end face on an electron beam output side (i.e., a surface opposed to the first intermediate electrode GM1). In the (3-2)th grid G3-2, an electric field correcting plate 26 is placed in which three electron beam passage apertures 25B, 25G, 25R respectively corresponding to the three electron beams are formed.

Figure 11:
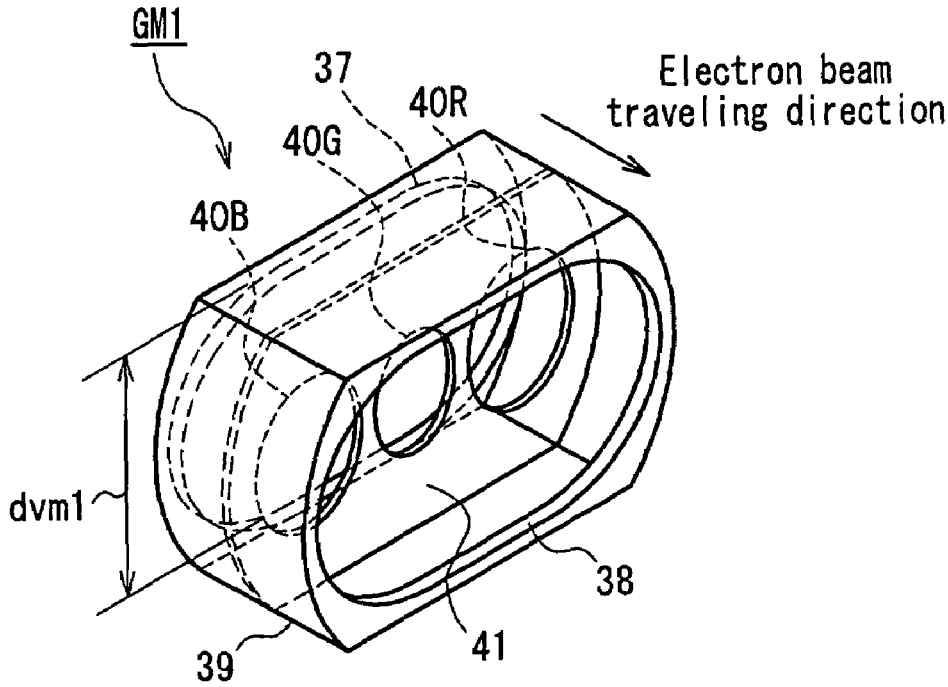
FIG. 11 is a perspective view showing a first intermediate electrode used in the electron gun of Embodiment 2 of the present invention.

As shown in FIG. 11, the first intermediate electrode GM1 is composed of a tubular body 39 in which oval electron beam passage apertures 37, 38 common to the three electron beams, having a major axis in the arrangement direction (horizontal direction) of the three electron beams and a minor axis in a direction orthogonal to the major axis (vertical direction), are formed respectively on an end face on an electron beam incident side (i.e., a surface opposed to the (3-2)th grid G3-2), and an end face on an electron beam output side. In the first intermediate electrode GM1, an electric field correcting plate 41 is formed in which three electron beam passage apertures 40B, 40G, 40R respectively corresponding to the three electron beams are formed.

Figure 12:
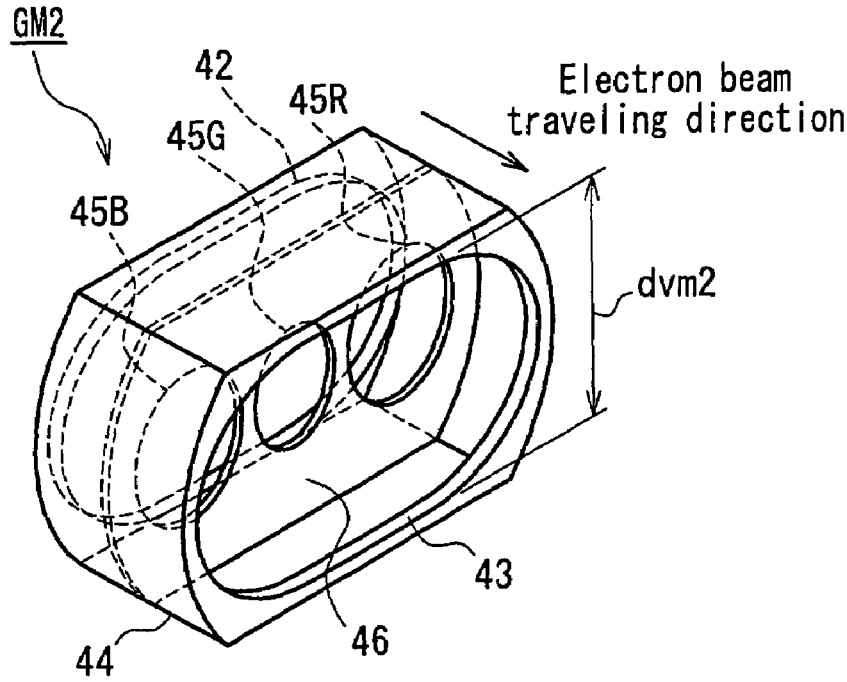
FIG. 12 is a perspective view showing a second intermediate electrode used in the electron gun of Embodiment 2 of the present invention.

As shown in FIG. 12, the second intermediate electrode GM2 is composed of a tubular body 44 in which oval electron beam passage apertures 42, 43 common to the three electron beams, having a major axis in the arrangement direction (horizontal direction) of the three electron beams and a minor axis in a direction orthogonal to the major axis (vertical direction), are formed respectively on an end face on an electron beam incident side, and an end face on an electron beam output side (i.e., a surface opposed to the fourth grid G4). In the second intermediate electrode GM2, an electric field correcting plate 46 is placed in which three electron beam passage apertures 45B, 45G, 45R respectively corresponding to the three electron beams are formed.

Figure 4:
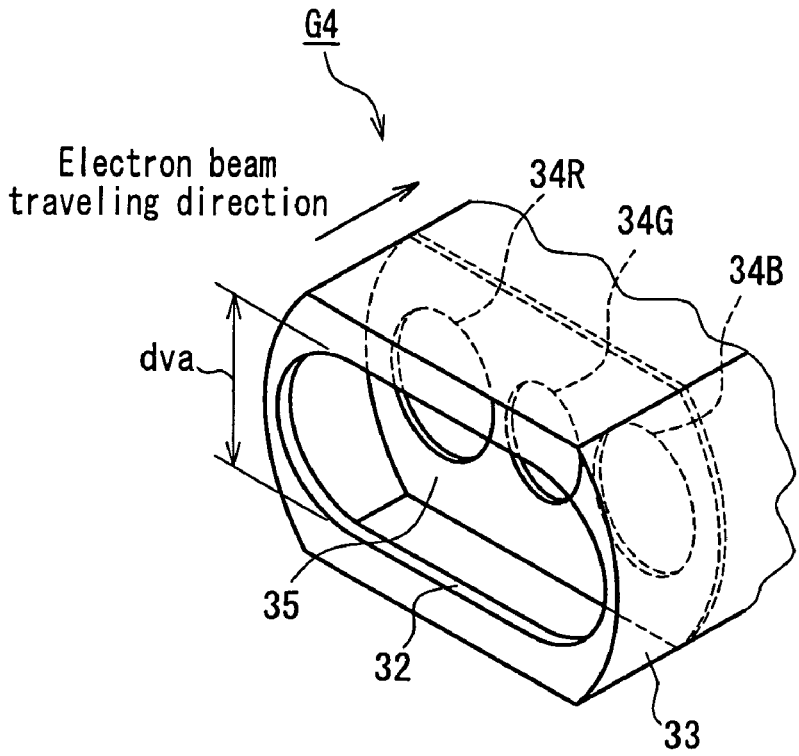
FIG. 4 is a perspective view showing a portion of an anode electrode used in the electron guns of Embodiments 1 and 2 of the present invention, opposed to the intermediate electrode.

The fourth grid (anode electrode) G4 is composed of a tubular body 33 in which, in the same way as in Embodiment 1 as shown in FIG. 4, an oval electron beam passage aperture 32 common to the three electron beams, having a major axis in the arrangement direction (horizontal direction) of the three electron beams and a minor axis in a direction orthogonal to the major axis (vertical direction), is formed on an end face of an electron beam incident side (i.e., a surface opposed to the second intermediate electrode GM2), and three electron beam passage apertures are formed on an end face on an electron beam output side. In the fourth grid G4, an electric field correcting plate 35 is placed in which three electron beam passage apertures 34B, 34G, 34R respectively corresponding to the three electron beams are formed.

A vertical dimension $d_{vf}$ of the electron beam passage aperture 23 common to the three electron beams of the (3-2)th grid G3-2 is smaller than a vertical dimension $d_{vm1}$ of the electron beam passage aperture 37 common to the three electron beams formed on a surface of the first intermediate electrode GM1 on the side opposed to the (3-2)th grid G3-2. Furthermore, a vertical dimension $d_{va}$ of the electron beam passage aperture 32 common to the three electron beams of the fourth grid G4 is smaller than a vertical dimension $d_{vm2}$ of the electron beam passage aperture 43 common to the three electron beams formed on a surface of the second intermediate electrode GM2 on the side opposed to the fourth grid G4.

In the above-mentioned electron gun, the cathodes K are supplied with a voltage of about 150 V, the first grid G1 is grounded, and the second grid G2 is supplied with a voltage of about 600 V. The (3-1)th grid G3-1 is supplied with a focus voltage of about 8 kV, and the (3-2)th grid G3-2 is supplied with a dynamic focus voltage that increases in accordance with the deflection distance of the electron beams on a base of about 8 kV. The first intermediate electrode GM1 is supplied with a voltage (first intermediate voltage) higher than the (3-2)th grid voltage (dynamic focus voltage), which is obtained by dividing an anode voltage with a resistor 47 housed in a tube. More specifically, the first intermediate voltage is about 9 kV to about 15 kV. In the present embodiment, the first intermediate voltage is set to be about 12 kV. The second intermediate electrode GM2 also is supplied with a voltage (second intermediate voltage) higher than the (3-2)th grid voltage (dynamic focus voltage), which is obtained by dividing an anode voltage with the resistor 47 housed in the tube. More specifically, the second intermediate voltage is about 14 kV to about 22 kV. In the present embodiment, the second intermediate voltage is set to be about 18 kV. The fourth grid G4 is supplied with a high voltage (anode voltage) of about 30 kV, which is higher than the first and second intermediate voltages. Thus, in the present embodiment, a potential difference E1 between the (3-2)th grid G3-2 and the first intermediate electrode GM1 is about 4 kV or less, and a potential difference E2 between the second intermediate electrode GM2 and the fourth grid G4 is about 12 kV. Thus, a relationship E1<E2 is satisfied.

Even in the electron gun of Embodiment 2, the same effect as that of Embodiment 1 can be obtained.

Figure 13:
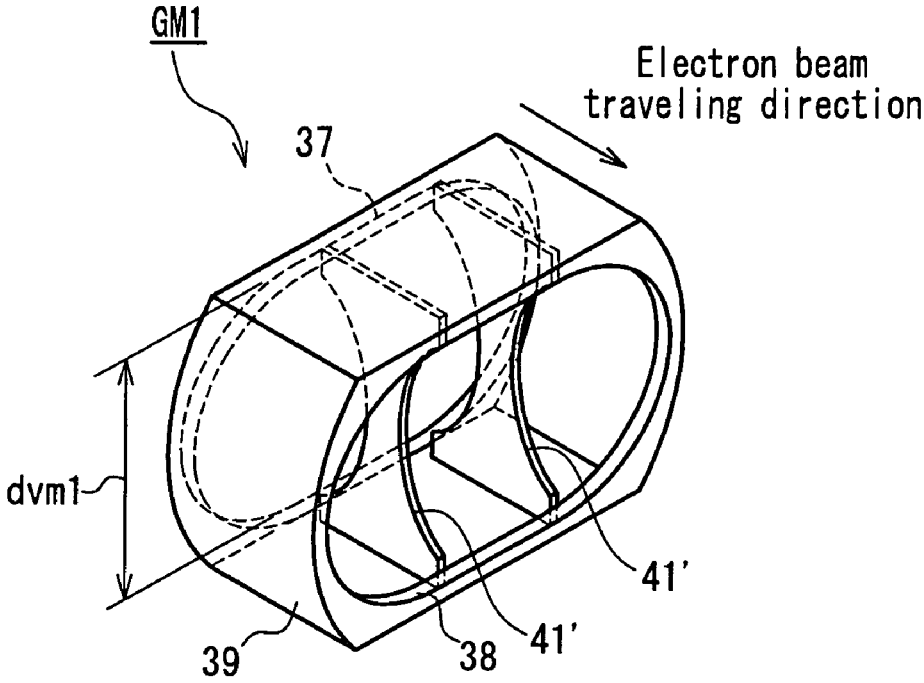
FIG. 13 is a perspective view showing another example of the first intermediate electrode used in the electron gun of Embodiment 2 of the present invention.
Figure 14:
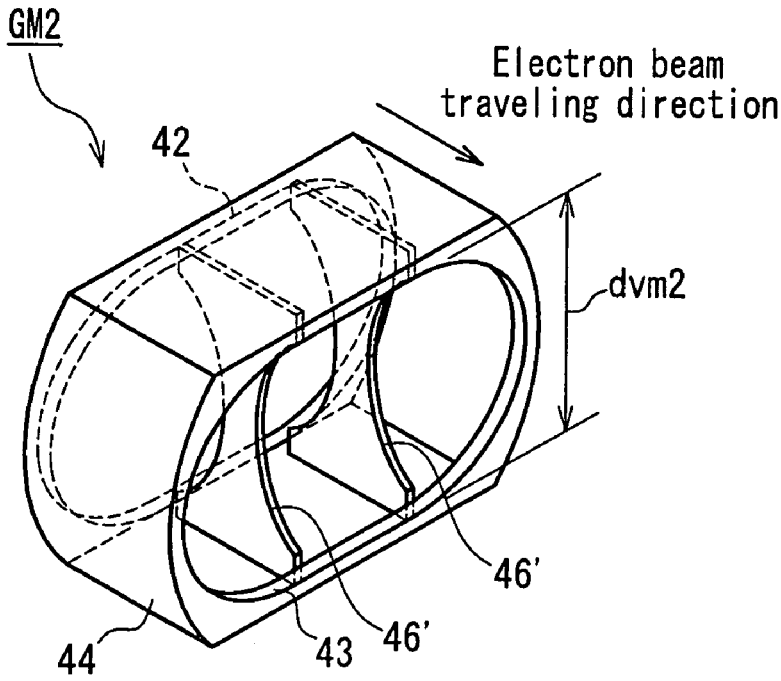
FIG. 14 is a perspective view showing another example of the second intermediate electrode used in the electron gun of Embodiment 2 of the present invention.

Even in Embodiment 2, in order to form three electron beam passage apertures through which the three electron beams pass in the respective tubular bodies 24, 39, 44, 33, the (3-2)th grid G3-2, the first intermediate electrode GM1, the second intermediate electrode GM2, and the fourth grid G4 respectively are provided with one electric field correcting plate 26, 41, 46, 35 placed at a right angle with respect to the traveling direction of the electron beams. However, the present invention is not limited thereto. For example, in the same way as in Embodiment 1, as respectively shown in FIGS. 5 and 7, in the (3-2)th grid G3-2 and the fourth grid G4, three electron beam passage apertures may be formed in the tubular bodies 24, 33 with two electric field correcting plates 26', 35' placed in parallel in the vertical direction and the traveling direction of the electron beams. Similarly, as respectively shown in FIGS. 13 and 14, in the first intermediate electrode GM1 and the second intermediate electrode GM2, three electron beam passage apertures may be formed in the tubular bodies 39, 44 with two electric field correcting plates 41', 46' placed in parallel in the vertical direction and the traveling direction of the electron beams. Furthermore, a method for forming the three electron beam passage apertures may be varied depending upon the electrode. For example, regarding the (3-2)th grid G3-2 and the first intermediate electrode GM1, three electron beam passage apertures may be formed with one electric field correcting plate 26, 41 shown in FIGS. 2 and 11, and regarding the second intermediate electrode GM2 and the fourth grid G4, three electron beam passage apertures may be formed with two electric field correcting plates 46', 35' shown in FIGS. 14 and 7.

Furthermore, regarding the first intermediate electrode GM1, the electric field correcting plates 41, 41' may be omitted. Furthermore, regarding the second intermediate electrode GM2, the electric field correcting plates 46, 46' may be omitted.

Figure 15:
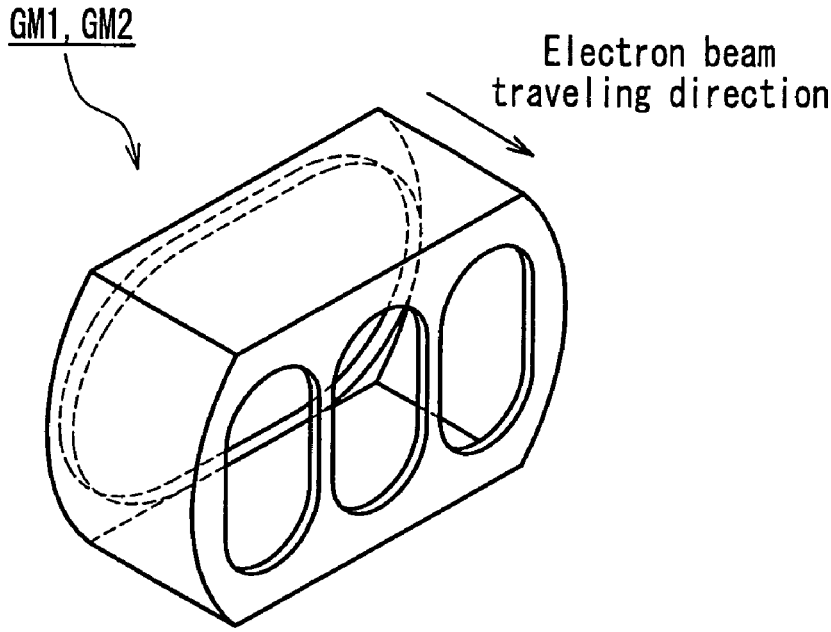
FIG. 15 is a perspective view showing still other examples of the first intermediate electrode and the second intermediate electrode used in the electron gun of Embodiment 2 of the present invention.
Figure 16:
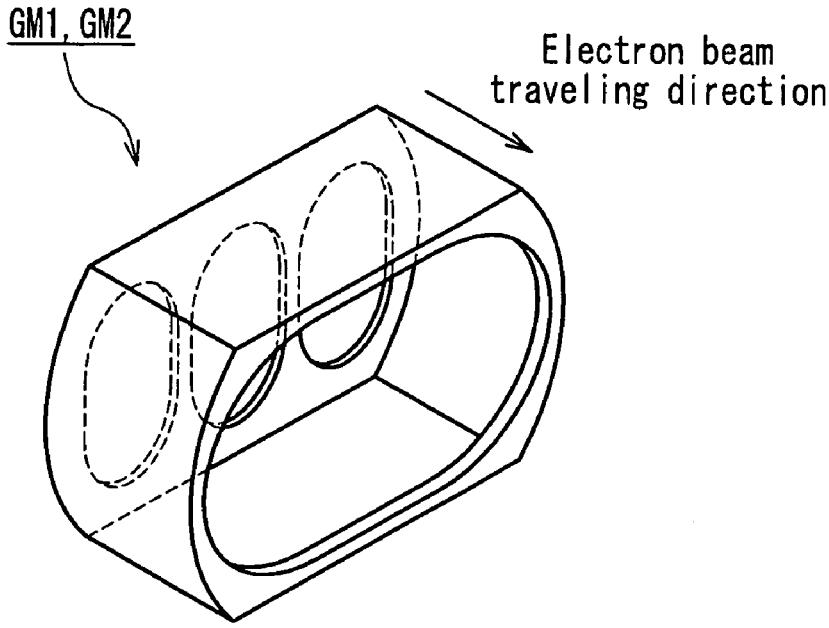
FIG. 16 is a perspective view showing still other examples of the first intermediate electrode and the second intermediate electrode used in the electron gun of Embodiment 2 of the present invention.

In this case, for example, as shown in FIG. 15, the first intermediate electrode GM1 and/or the second intermediate electrode GM2 may be those in which an oval electron beam passage aperture common to the three electron beams is formed on the end face on the electron beam incident side, and three electron beam passage apertures respectively corresponding to the three electron beams are formed on the end face on the electron beam output side. Alternatively, as shown in FIG. 16, the first intermediate electrode GM1 and/or the second intermediate electrode GM2 may be those in which three electron beam passage apertures respectively corresponding to the three electron beams are formed on the end face on the electron beam incident side, and an oval electron beam passage aperture common to the three electron beams is formed on the end face on the electron beam output side. Irrespective of the configurations of the first intermediate electrode GM1 and the second intermediate electrode GM2, the vertical dimension $d_{vf}$ of the oval electron beam passage aperture 23 common to the three electron beams formed on the end face on the electron beam output side of the (3-2)th grid (focus electrode) G3-2 only needs to be smaller than the vertical dimension $d_{vm1}$ of the electron beam passage aperture formed on the end face on the electron beam incident side of the first intermediate electrode GM1 opposed to the (3-2)th grid G3-2, and the vertical dimension $d_{va}$ of the oval electron beam passage aperture 32 common to the three electron beams formed on the end face on the electron beam incident side of the fourth grid (anode electrode) G4 only needs to be smaller than the vertical dimension $d_{vm2}$ of the electron beam passage aperture formed on the end face on the electron beam output side of the second intermediate electrode GM2 opposed to the fourth grid G4.

In both of the above-mentioned Embodiments 1 and 2, although an exemplary BPF-type DAF system electron gun has been shown, the present invention is not limited thereto. More specifically, the present invention may be applied to a multi-stage focus type electron gun provided with a preliminary focusing lens between the prefocus lens and the main lens, or may be applied to a static focus type electron gun in which only a predetermined focus voltage is applied.

The applicable field of the color Braun tube apparatus of the present invention is not particularly limited, and the present invention can be used as a color Braun tube apparatus used, for example, in a television, a computer display, or the like requiring high display quality, since satisfactory image quality can be realized.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color Braun tube apparatus, comprising: an electron gun having an electron beam generating part for generating three electron beams, including a center electron beam and a pair of side electron beams on both sides of the center electron beam, on an identical horizontal plane and a plurality of electrodes that form a main lens and have an electron beam passage aperture; and a deflection yoke for allowing the three electron beams emitted from the electron gun to scan in a horizontal direction and a vertical direction, the main lens accelerating and focusing the three electron beams generated from the electron beam generating part with respect to a screen, wherein the main lens is formed by a focus electrode to be supplied with a focus voltage, at least one intermediate electrode to be supplied with an intermediate voltage higher than the focus voltage, and an anode electrode to be supplied with an anode voltage higher than the intermediate voltage, arranged successively in a traveling direction of the three electron beams, the focus electrode and the anode electrode respectively are composed of a tubular body in which a noncircular electron beam passage aperture common to the three electron beams, having a major axis in the horizontal direction and a minor axis in the vertical direction, is formed in a portion opposed to the intermediate electrode, three electron beam passage apertures through which the three electron beams pass are formed in the respective tubular bodies constituting the focus electrode and the anode electrode, an aperture dimension in the vertical direction of the noncircular electron beam passage aperture common to the three electron beams formed in the focus electrode is smaller than an aperture dimension in the vertical direction of the electron beam passage aperture formed in a portion of the intermediate electrode opposed to the focus electrode, and an aperture dimension in the vertical direction of the noncircular electron beam passage aperture common to the three electron beams formed in the anode electrode is smaller than an aperture dimension in the vertical direction of the electron beam passage aperture formed in a portion of the intermediate electrode opposed to the anode electrode.

2. The color Braun tube apparatus according to claim 1, wherein the intermediate electrode is composed of a tubular body in which a noncircular electron beam passage aperture common to the three electron beams, having a major axis in the horizontal direction and a minor axis in the vertical direction, is formed in the portion opposed to the focus electrode.

3. The color Braun tube apparatus according to claim 1, wherein the intermediate electrode is composed of a tubular body in which a noncircular electron beam passage aperture common to the three electron beams, having a major axis in the horizontal direction and a minor axis in the vertical direction, is formed in the portion opposed to the anode electrode.

4. The color Braun tube apparatus according to claim 1, wherein the intermediate electrode is composed of a tubular body in which a noncircular electron beam passage aperture common to the three electron beams, having a major axis in the horizontal direction and a minor axis in the vertical direction, is formed respectively in the portion opposed to the focus electrode and the portion opposed to the anode electrode.

5. The color Braun tube apparatus according to claim 1, wherein, assuming that a potential difference between the focus electrode and the intermediate electrode opposed to the focus electrode is E1, and a potential difference between the anode electrode and the intermediate electrode opposed to the anode electrode is E2, a relationship E1<E2 is satisfied.

6. The color Braun tube apparatus according to claim 1, wherein the three electron beam passage apertures through which the three electron beams pass are formed in a 3-opening electric field correcting plate positioned between end faces of the focus electrode, a second 3-opening electric field plate positioned between end faces of the intermediate electrode, and a third 3-opening electric field plate positioned between end faces of the anode electrode.

* * * * *